United States Patent [19]

Brescia

[11] 4,150,902

[45] Apr. 24, 1979

[54] ELECTRONIC PRINTER HAVING A SINGLE TRACING ELEMENT FOR TRACING OUT ALPHANUMERIC CHARACTERS

[75] Inventor: Riccardo Brescia, Ivrea, Italy;

[73] Assignee: Ing. C. Olivetti & C., S.P.A., Italy

[21] Appl. No.: 814,135

[22] Filed: Jul. 8, 1977

[30] Foreign Application Priority Data

Jul. 19, 1976 [IT] Italy ..... 68797 A/76
Jun. 10, 1977 [IT] Italy ..... 68353 A/77

[51] Int. Cl.[2] ..... B41J 3/04

[52] U.S. Cl. ..... 400/17; 400/18; 346/140 A

[58] Field of Search ..... 197/1 R; 178/30; 33/1 M, 18 R; 346/140 R, 140 A; 340/324 A; 400/17-19, 124, 118

[56] References Cited

U.S. PATENT DOCUMENTS

| | | | |
|---|---|---|---|
| 4,271 | 11/1845 | Thurber | 197/1 R |
| 1,715,781 | 6/1929 | Pein | 197/1 R X |
| 1,732,104 | 10/1929 | Mee | 197/1 R |
| 2,251,616 | 8/1941 | Perry | 197/1 R |
| 3,087,772 | 4/1963 | Ascoli | 346/140 R |
| 3,182,126 | 5/1965 | Ascoli | 197/1 R X |
| 3,342,936 | 9/1967 | Ascoli et al. | 178/30 |
| 3,349,176 | 10/1967 | Ascoli | 178/30 |
| 3,696,388 | 10/1972 | Eichelberger | 340/324 A |
| 3,805,274 | 4/1974 | Kashio | 178/30 X |
| 3,972,052 | 7/1976 | Atumi et al. | 197/1 R X |

FOREIGN PATENT DOCUMENTS

| | | | |
|---|---|---|---|
| 1244794 | 9/1960 | France | 197/1 R |
| 2257429 | 8/1975 | France | 197/1 R |

*Primary Examiner*—Paul T. Sewell

[57] ABSTRACT

The printer is provided with a single tracing element for tracing characters under the control of stored digital instructions corresponding to a set of segments of the character. The tracing element is moved on the printing surface according to a pair of coordinates, within the limits of each character. To this end it is carried by a frame including a pair of hinged elements directed according to the two coordinates and moved by a pair of electromagnets. These latter are controlled by feed back circuits including a pair of position sensors. The frame is mounted on a carriage transversely movable according to other instruction for letter spacing. A movement of the printing element according to a third coordinate causes the tracing element to press the paper with a pressure corresponding to the thickness of the sign. The instructions of each segment include the speed of the tracing element along the two coordinates, whereby by altering either the time interval of operation or the amplitude of signals, the character can be altered in sizes along one or two coordinates. The instructions of one or more alphabets or type fonts are stored in a pluggable ROM addressable by input signals. The printer is particularly adapted for electronic typewriters, word processing apparatus, as well as for running hand and ideographic characters, for example, characters of Arabic, Urdu, Chinese, Kanji etc. languages.

44 Claims, 19 Drawing Figures

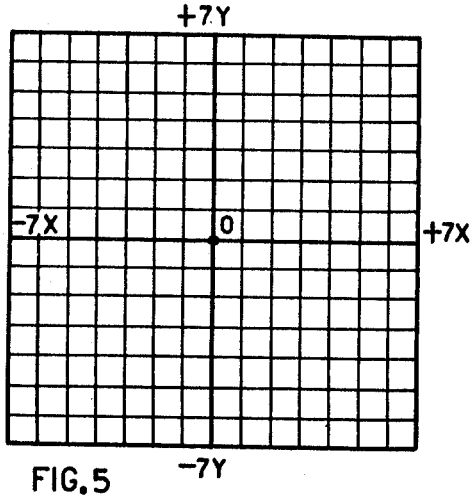
FIG. 5
FIG. 7a
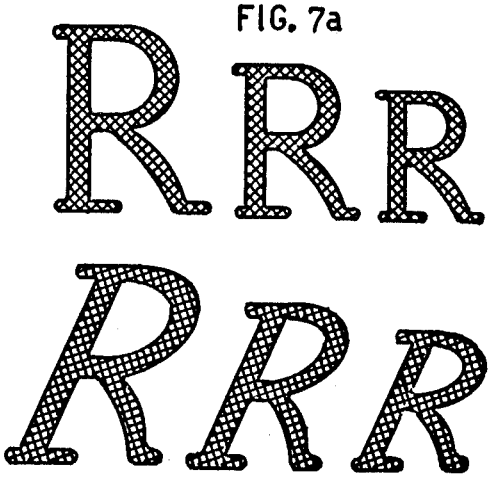
FIG. 7b
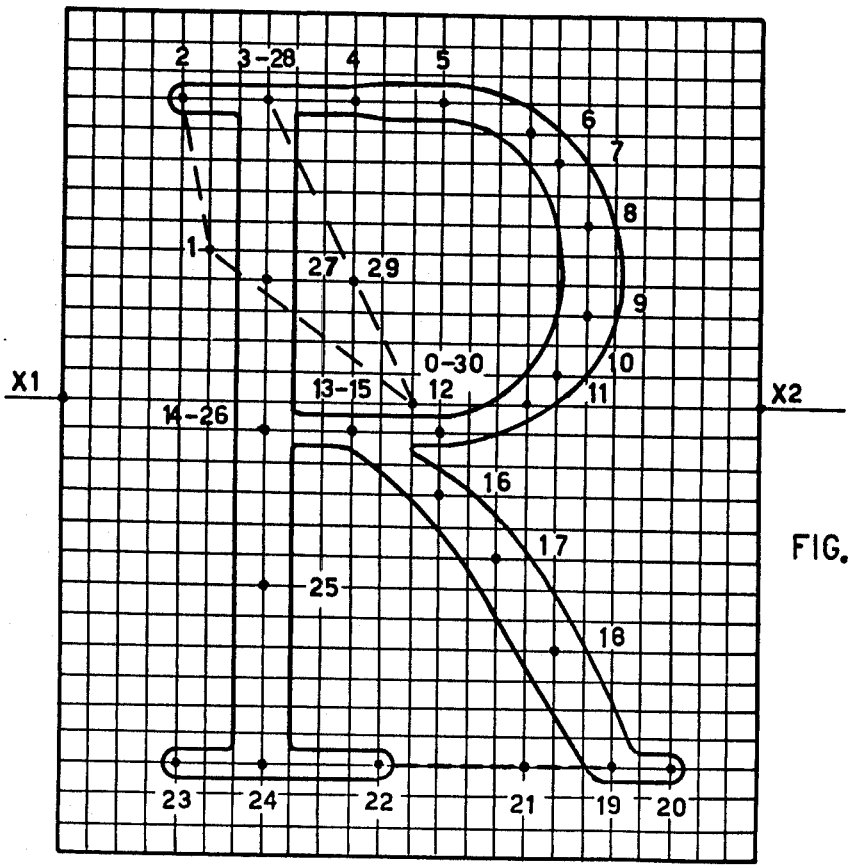
FIG. 6

ELECTRONIC PRINTER HAVING A SINGLE TRACING ELEMENT FOR TRACING OUT ALPHANUMERIC CHARACTERS

BACKGROUND OF THE INVENTION

The invention relates to an electronic printer having a single element for tracing out alphanumeric characters.

There are known printers of the plotter type, in which the characters are traced out by a printing stylus under the control of stepping motors which cause a translation of the printing stylus and a rotation of the platen, respectively.

The known dot or plotter-type printing systems require the generation of separate codes not only for each different type style, but also for each variation in its dimensions and in the ratio between height and width of the character. Also the known ink jet printers, in which the jet is deflected by an electrostatic field or by means of an equivalent system, while able to attain very high printing speeds, cannot reach high quality of the printing because of the lack of rigid control of the actual movement imparted to the ink jet.

The same disadvantages are presented by other proposed printing devices or systems which plot the character by using the displacement of a stylus or a similar writing or printing element without this displacement being rigidly controlled, including the plotters where the stylus is controlled through the entire line.

In such known devices the shape of the character plotted can be altered by the effect of extraneous factors such as the times of response of the actuating devices, forces of inertia, the play of the printing elements and the friction against the paper.

The main object of the invention is to provide an easy and inexpensive interchangeability of the type style and of their dimensions in a printer capable of printing with an excellent quality and a practically unlimited choice of the type styles and the dimensions of the characters for any alphabet, Latin, Cyrillic, Arabic, Chinese, etc.

SUMMARY OF THE INVENTION

According to the invention, there is now provided a non-impact printer having a single tracing element for tracing alphanumeric characters, comprising spacing means for relatively moving said tracing element and the paper in a letter spacing relationship, driving means for shifting said tracing element along a pair of coordinates parallel to the printing plane independently of the said letter spacing, for tracing each character, storing means for storing a set of addressable numeric instructions for each one of said characters, addressing means conditionable for sequentially addressing the instructions of a predetermined character, printing control means operable for conditioning said driving means according to a character to be printed, detecting means for detecting the position of said tracing element, D/A converting means for converting the numerical instructions so addressed, comparison means for comparing the signals given by said detecting means and by said converting means, and servo control means conditioned by said comparison means for controlling said driving means.

BRIEF DESCRIPTION OF THE DRAWINGS

This and other characteristics of the invention will become apparent from the following description of an embodiment of the invention, given by way of example, and from the accompanying drawings, in which:

FIG. 5 is a basic grid for the generation of the characters;

FIG. 6 is an example of a character traced according to the invention;

FIGS. 7*a* and 7*b* are examples of a character printed with different dimensions and with different inclinations respectively;

DETAILED DESCRIPTION OF THE PREFERRED EMBODIMENTS

The printer according to the invention can be embodied in electronic typewriters as well as in teleprinters, terminals, printers for calculators and computers, etc.

Figure 1:
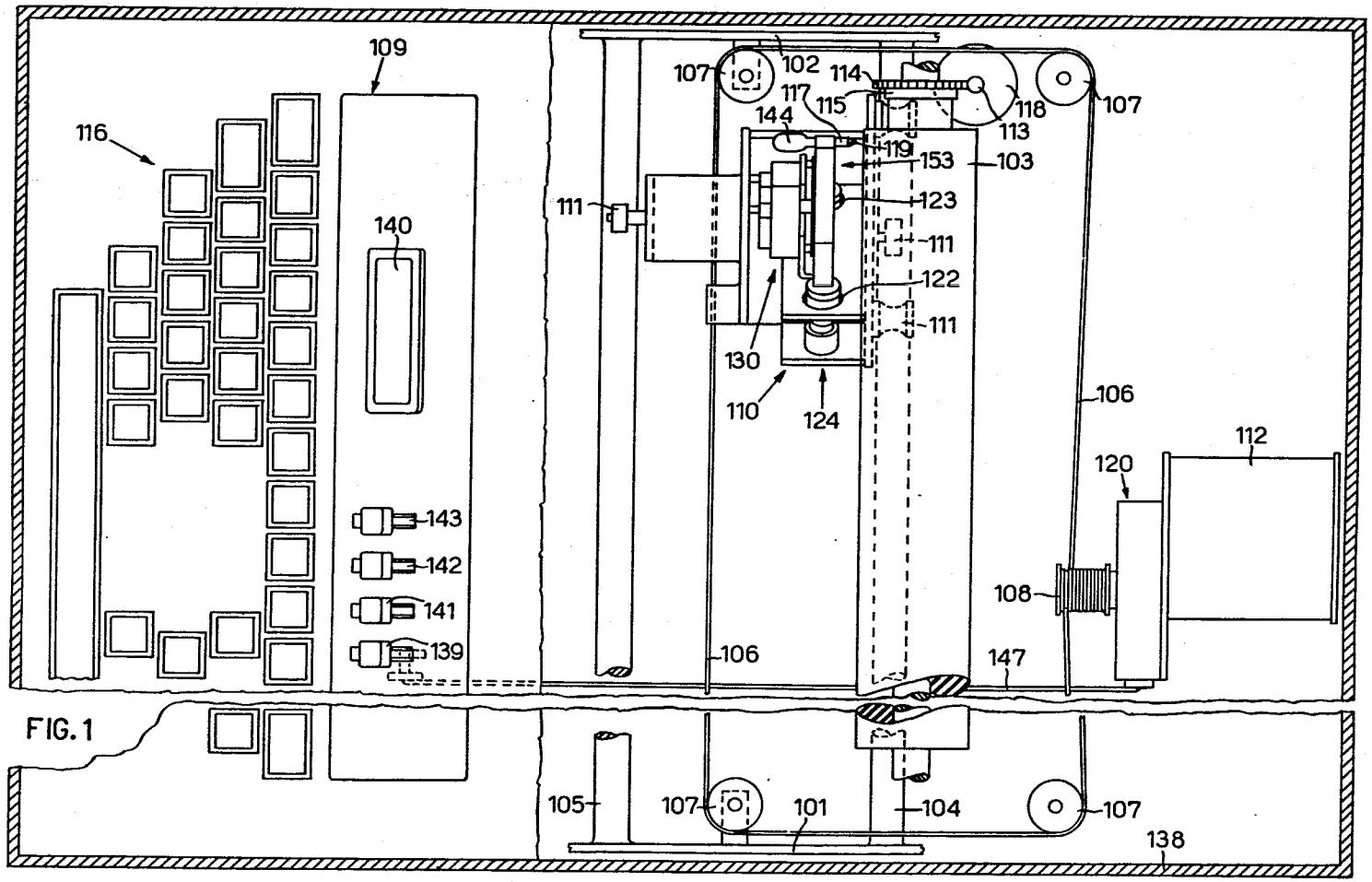
FIG. 1 is a general plane view of a typewriter embodying a printer according to the invention.
Figure 2:
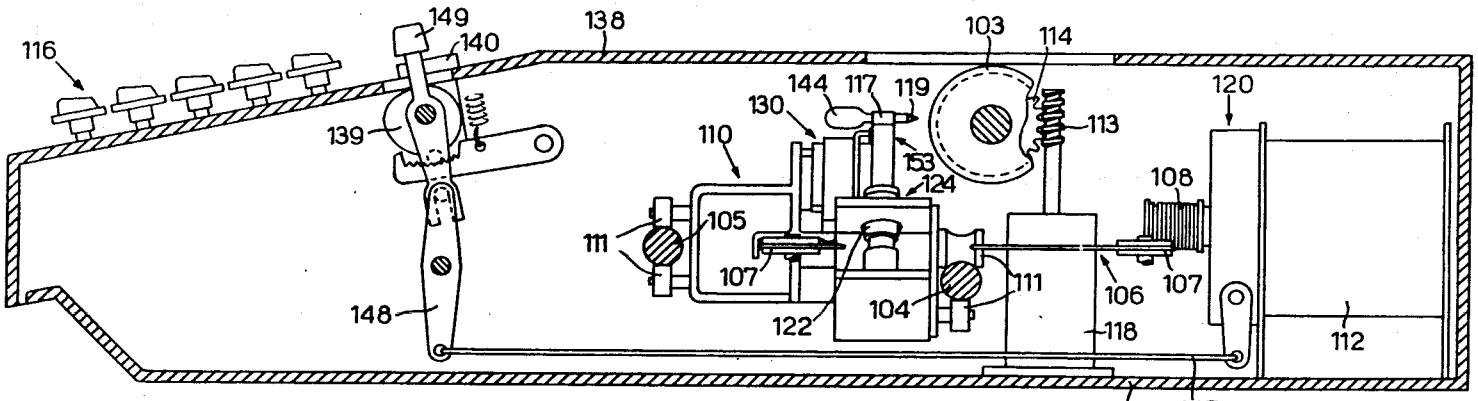
FIG. 2 is a longitudinal sectional view of the machine of FIG. 1.

Hereinafter the printer is described as embodied in an electronic typewriter (FIGS. 1 and 2) 138 having a main frame including two side walls 101 and 102 connected by two guides 104 and 105, a platen 103 supported by the walls 101 and 102, a print element carriage 110 slidable with low friction parallely to the platen 103 on the guides 104 and 105 by means of rollers 111. An alphanumeric keyboard 116 is connected to an electronic encoder 202 (FIG. 4) and is adjacent a console 109 (FIG. 1). The typewriter also includes a spacing device for advance of the carriage 110, including a thin steel cable 106 guided by pulleys 107 mounted on the side walls 101 and 102. The cable 106 is wound on a drum 108 which can be rotated by a motor 112 which defines the rotation of the drum 108 through a speed change device 120. Another motor 118, through a worm 113, a gear 114 and a friction clutch 115, rotates the platen 103 for line-spacing.

The motor 112 is of stepping type and is controlled by a driving circuit 243 (FIG. 4) in a known manner.

Upon printing each character, the motor 112 is rotated a corresponding number of steps corresponding to an advancement of the carriage 110 depending on the positioning of the device 120, as it will be made clear hereinafter. Each character is traced with the carriage 110 and the paper stationary, solely by the movement of a printing element in form of a pen 117 along the coordinates or axes X and Y. The carriage 110 advances at the end of the printing of each character, while the point 119 of the pen 117 is not in contact with the paper.

The stepping motor 118 for the line spacing is controlled by a driving circuit 260 (FIG. 4) similar to that of the motor 112. The motor 118 advances the paper a predetermined number of elementary steps, as it will be made clear hereinafter.

The pen 117 is conditioned to trace or plot the characters by combining the movements in the three directions: parallel to the movement of the platen 103 (X axis), perpendicular to this platen movement and parallel to the paper (Y axis), and perpendicular to the paper (Z axis) according the instructions of a program.

The pen 117 includes a ball point 119 and a large-capacity pressurized reservoir 144. Of course, the ball pen 117 can be replaced by an ink jet unit, or by a stylus which operates with the interposition of a carbon coated ribbon.

Figure 3C:
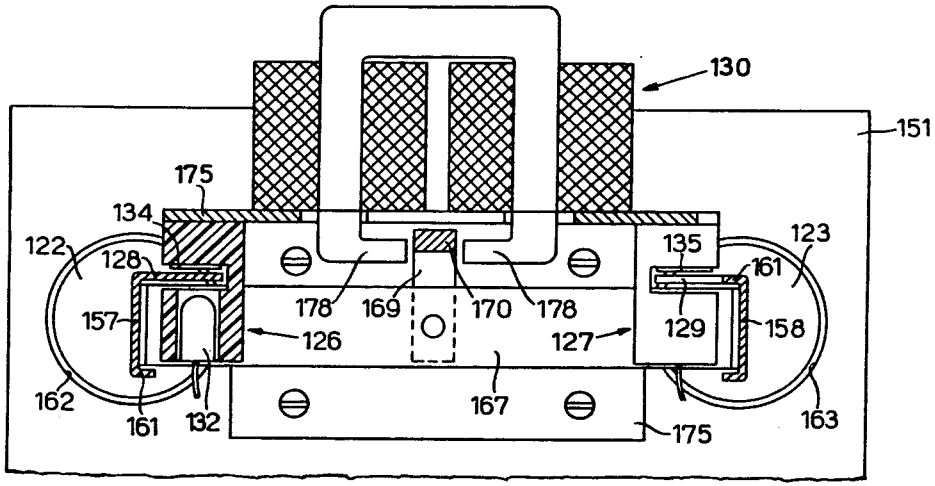
FIG. 3*c* is a plan view taken along line III*c*—III*c* of FIG. 3*a;*

The printer, which will be hereinafter called mini-plotter (FIG. 3), includes an electromagnet 124 mounted on the carriage 110 and including a single permanent magnet 125 with two pole pieces 151 and 152 of magnetic material and two moving coils 122 and 123. The pole piece 151 has two holes concentric with two cylindrical magnetic cores 164 and 165 fixed to the pole piece 152. The diameter of these cores at the pole piece 151 is smaller than that of the holes, so that between the cores and the pole piece there are formed two annular air gaps 162 and 163 of a width sufficient to allow free sliding of the moving coils 122 and 123, as well as a lateral translation thereof for a few tenths of a millimeter without coming into contact with the walls of the air gaps 162, 163. The permanent magnet 125 creates a magnetic field in the two air gaps 162 and 163.

The pen 117 and the two moving coils 122 and 123 are carried by a single frame generically indicated with 153 made of beryllium bronze sheet. The frame 153 includes six separate elements 157, 158, 159, 160, 166 and 167. The elements 157, 158, 159, 160 are rigid since they are stiffened by U-shaped ribs 161, while the elements 166 and 167 are flexible.

Figure 3B:
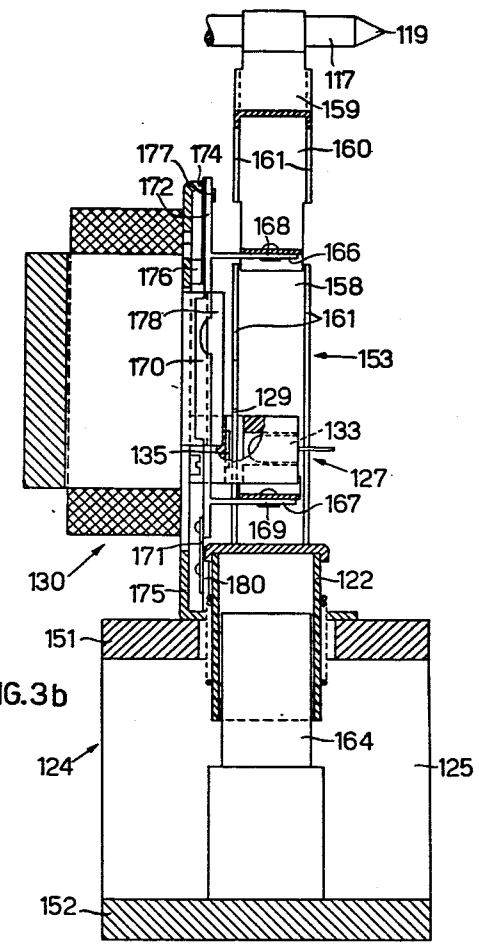
FIG. 3*b* is a sectional view taken along line III*b*—III*b* of FIG. 3*a;*
Figure 3A:
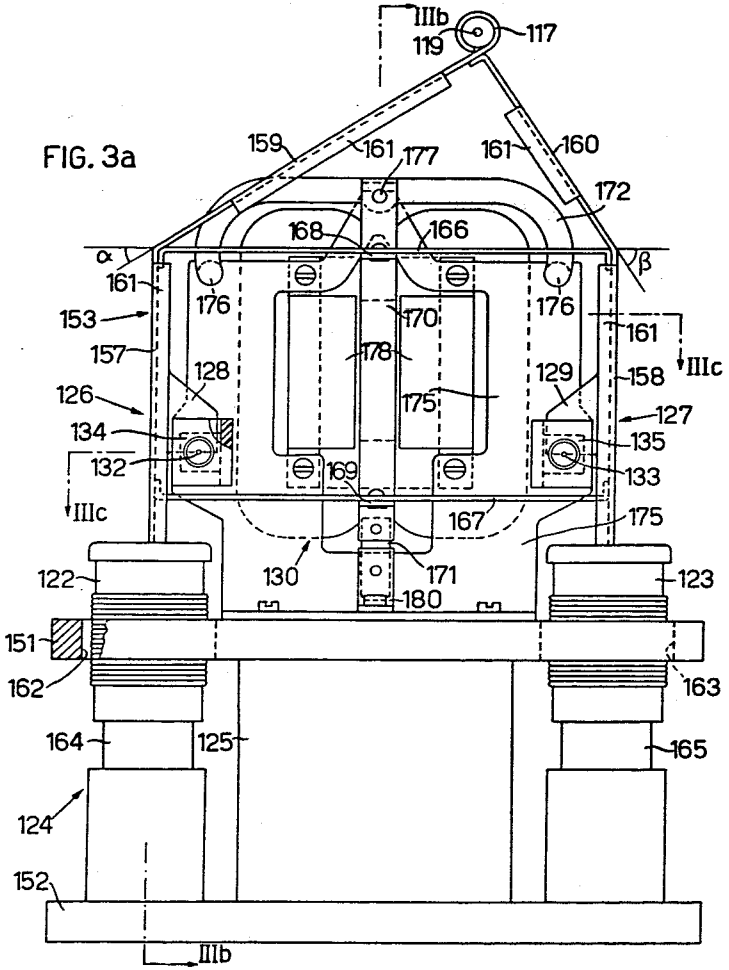
FIG. 3*a* is a front view of a printer according to a first embodiment of the invention.

The elements 157 and 158 are secured each one to the corresponding moving coils 122, 123. The elements 159 and 160 are perpendicular to each other and define the X and Y axes of movement of the pen 117, the transverse movement of the carriage 110 being parallel to the element 109. The printing head of FIGS. 3*a* and 3*b* is represented rocked by an angle $\alpha$ counterclockwise for simplicity of representation only. The elements 166 and 167 are coupled at their central points to two lugs 168 and 169 projecting from a magnetic armature 170. Together with this armature, the rigid elements 157 and 158 and the flexible elements 166 and 167 of the frame 153 constitute two substantially similar parallelograms, so that the rigid elements 157 and 158, and coils 122 and 123, are moved solely in a direction parallel to the armature 170.

Since the armature 170 is substantially parallel to the axes of the cores 164 and 165 of the electromagnet 124, the moving coils 122 and 123 are also moved substantially parallel to these cores. The armature 170 is a part of a suction electromagnet 130, comprising two pole pieces 178, and is connected to a frame 175 by means of a first leaf spring 171 connecting the lower end of the armature 170 with a bent member 180 secured to the frame 175, and by means of a second leaf spring 172 connecting a pin 177 of the upper end of the armature 170, with a pair of symmetrical projections 176 of the frame 175. The leaf springs 171 and 172 allow an oscillation of a few tenths of a millimeter of the pin 177 in a direction perpendicular to the frame 175, with the leaf spring 171 acting as a hinge. This oscillation causes a movement of the pen 117 in a direction perpendicular to the platen 103, that is in the movement along the Z axis.

When the suction electromagnet 130 is deenergized, the frame 153 is held against a bent edge 174 of the frame 175 by the leaf springs 171 and 172, with the point 119 of the pen 117 about 0.5mm from the paper. Upon energization of the electromagnet 130 the pen 117 is urged against the paper, with a force determined by the sucking action of the pole pieces 178 on the armature 170. The coils 122 and 123 are so close to the leaf spring 171, that the movement of the armature 170 does not affect the operation of the electromagnet 124 in any way.

The two moving coils 122 and 123 define the movement of the pen 117 along the X and Y axes, respectively. The two elements 159 and 160 of the frame 153, which are at right angles to one another, in fact compound the movements of the two moving coils 122 and 123, into two movements at right angles with an amplitude proportional respectively to the shifting of the moving coils 122 and 123, and to the sines of the angles $\alpha$ and $\beta$ which these elements form with respect to the element 166. Therefore, the movements of the moving coils 122 and 123, are converted into movements of the pen 117 directed along the X and Y axes, respectively. The angles $\alpha$ and $\beta$, which are 33° and 57°, respectively, have been chosen so that the maximum strokes of the moving coils 122 and 123 in tracing any character are equal, even if the maximum movement of the pen 117 along the Y axis is greater than the maximum movement along the X axis.

Since all the hinges of the frame 153 which define the movement of the pen 117 along the three axes X, Y and Z are represented by flexible leaf springs devoid of any clearance, the pen 117 is positioned at any instant without any clearance with respect to the carriage 110.

The frame 175 carries also two optoelectronic sensors 126 and 127 known per sè for sensing the mouvement of the coils 122 and 123. The sensors 126 and 127 comprise each one a corresponding light-emitting diode 132, 133 of the so called LED type, illuminating a corresponding solar battery 134, 135. Between the LEDs 132 and 133 and the corresponding solar batteries 134 and 135, there are interposed two lugs 128 and 129 bent from the elements 157 and 158 which are thus bodily movable with the movement of the coils 122 and 123. The light which strikes the solar batteries 134 and 135, and therefore the signal which they generate, is proportional to the stroke of the moving coils 122 and 123.

Figure 9:
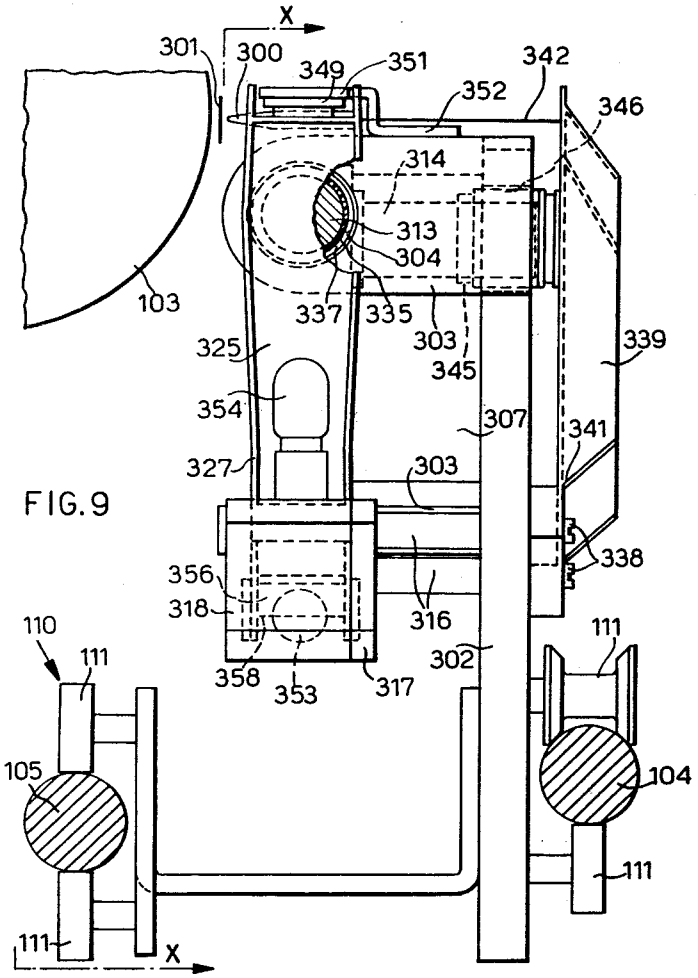
FIG. 9 is a lateral view of a second embodiment of the printer according to the invention.

According to another embodiment of the invention, the printing or tracing element includes a stylus 300 (FIG. 10) adapted to print on the paper carried by the platen 103 through an inked ribbon 301. The stylus is carried by a structure including a rigid steel plate 302 secured to the carriage 110. The plate 302 is provided with a pair of bent lugs 303 perpendicular to each other and each one provided with a circular hole 304 (FIG. 9).

Figure 11:
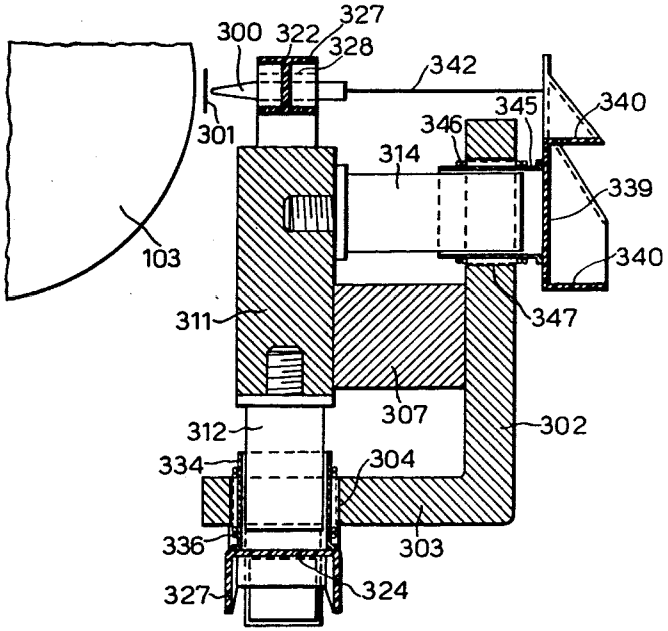
FIG. 11 is a sectional view taken along line XI—XI of FIG. 10.

A permanent magnet 307 (FIG. 11) is secured to the plate 302 by a pair of screws 306. The magnet 307 has a shape substantially cylindrical and is provided with a pair of prismatic projections 308 each one facing one lug 303. A second steel plate 311 is secured to the magnet 304 by another pair of screws 309. Secured on the plate 311, in correspondence with the lugs 303, there are two magnetic cores 312 and 313 of cylindrical shape, coaxial with the holes 304 and having the axis directed along axes X and Y of the movement of the stylus 300.

Another magnetic core 314 (FIG. 11) is secured to the plate 311, coaxial with a hole 347 of the plate 302, and has a cylindrical shape with the axis directed along the Z axis of the movement of the stylus 300.

Figure 10:
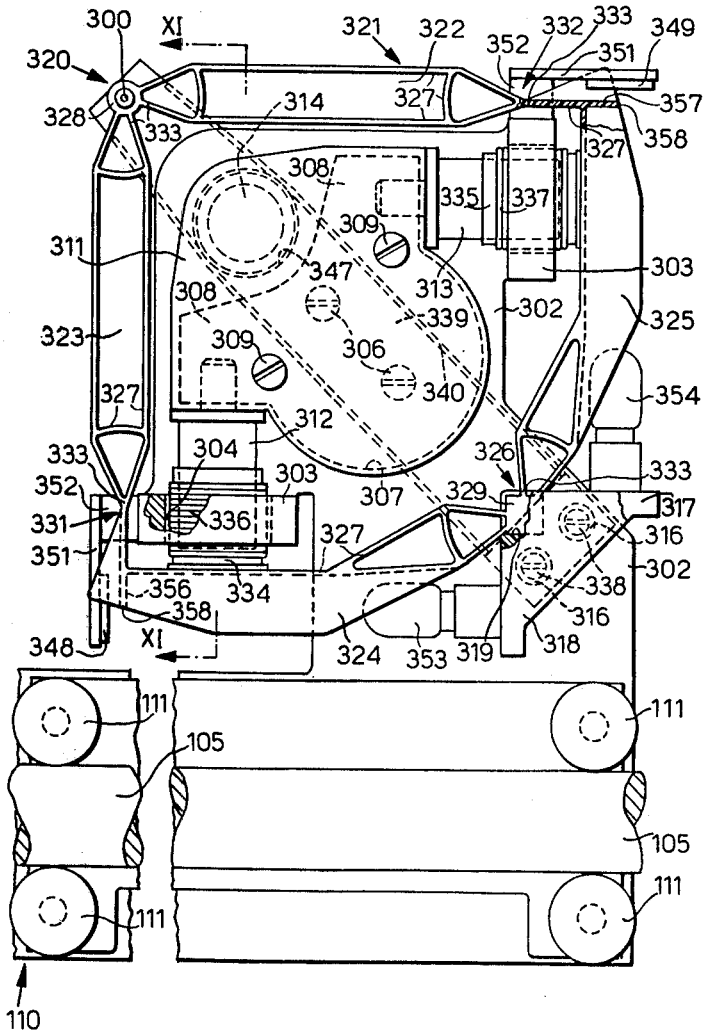
FIG. 10 is a front view of the printer taken along line X—X of FIG. 9.

Secured to the plate 302 is also a pair of columns 316 (FIG. 9) integral with a substantially triangular plate 317 (FIG. 10). This latter is secured to a prismatic block 318 having a cross section equal to the plate 317. The block 318 is provided with a prismatic vane 319 having a square cross section.

The stylus 300 is mounted on a vertex 320 of a frame, in form of a hinge parallelogram of quadrilater, generically indicated with 321. Particularly, the frame 321 comprises a pair of arms 322 and 323 converging on the vertex 320 and another pair of arms 324 and 325 converging on a vertex 326 opposite to the vertex 320. The four arms 322–325 have equal length and are molded with a very light plastic material, each one strenghtened with suitable ribs 327.

The arms 322 and 323 may be molded in a single piece with a hole sleeve 328 in correspondence with the vertex 320, for slidably guiding the stylus 300. Similarly the arms 324 and 325 may be molded in a single piece with a prismatic block 329 in correspondence with the vertex 326. The block 329 is housed into the vane 319 of the block 318, whereby the frame is fitted on the vertex 326. The two pieces 322, 323 and 324, 325 can be mutually bonded in correspondence with the other two vertexes 331 and 332 of the frame 321. Alternatively, the entire frame 321 may be molded as a whole in a single piece. The hinges of the frame 321 are formed by end portions 333 of the adjacent arms 322–325, which are elastically flexible, so as to restore the frame 321 and therefore the stylus 300 in the rest position of FIG. 2, when the action for the controlled movement of the stylus 300 is interrupted.

A hub 334, respectively 335, made with insulating material, is secured, for example bonded, on each of the two arms 324, 325, coaxially with the corresponding cores 312, 313. Each hub 334, 335 is wound with a corresponding electric coil 336, 337, freely movable into the hole 304 of the corresponding lug 303, whereby the coils 336 and 337 are movable with respect to the relevant stationary cores 312 and 313.

When the coils 336 and 337 are variably energized, in the manner to be described, they are urged to move bodily with the corresponding hubs 334 and 335, axially along the cores 312 and 313, thus rocking the corresponding arms 324 and 325. The movements of these arms are transmitted by means of the arms 323 and 322 to the stylus 300, thus defining the displacement of this latter on the plane X, Y.

Another arm 339 is provided with a lower end secured by means of a pair of screws 338 on the plate 302. The arm 339 is directed substantially from the vertex 326 to the vertex 320 of the frame 321. The arm 339 is also molded with a very light plastic and provided with strenghtening ribs 340. A portion 341 (FIG. 9) of the arm 339 near its lower end is elastically flexible, whereas its upper end is secured to an end of a push member 342. The other end of this member 342 is secured to the printing stylus 300. Secured to the arm 339 is also a hub 345 of insulating material. The hub 345 is coaxial with the core 314 and is wound with a third moving coil 346 (FIG. 11) freely movable into the hole 347 of the plate 302.

When the coil 346 is variable energized, in the manner to be described, it is moved, bodily with hub 345, axially with respect to the core 314 and rocks the arm 339 (FIG. 9) by flexing the portion 341. The arm 339, through the push member 342, causes the printing stylus 300 to contact the paper, through the inked ribbon 301. The character is thus traced out in each portion with a thickness corresponding to the pressure of the stylus 300 produced by the coil 346. If the energization of the coil 346 is accidentally interrupted, the stylus 300 is removed from the paper by the elasticity of the portion 341 of the arm 339.

From the above description it is evident that the single permanent magnet 307 (FIG. 11) generates the magnetic flux or field required by the three movable coils 336, 337 and 346. Particularly, the magnet 307, through the plate 311 and the cores 312, 313 and 314 (FIG. 10), generates the magnetic field in the air gap existing between the hole 304 of each lug 303 and the cores 312 and 313. The magnet 307 also generates, through the plate 302, the magnetic field in the air gap existing between the hole 347 of the plate 302 and the core 314.

The movements of the movable coils 336 and 337 (FIG. 10), and therefore of the printing stylus 300 along the axes X and Y, are controlled by feedback controlled driving devices to be described, which include a pair of photocells 348 and 349. Each one of these photocells is secured to a bent lug 351 of a corresponding plate 352, in turn secured to the corresponding lug 303 of the plate 302. Each photocell 348, 349 cooperates with a corresponding lamp 353, 354 carried by the block 318. The light of each lamp 353 and 354 toward the corresponding photocell 348 and 349 is intercepted by a shutter formed of a lug 356, respectively 357, integral with the corresponding arm 324, 325. At rest, the free edge 358 of each lug 356, 357 is located on a diametral plane common to the photocell 348, 349 (FIG. 10) and the lamp 354, 353. Any movement of each coil 336, 337, and therefore of the lugs 356, 357 of the relevant arms 324, 325, causes an increasing of the light which from the lamps 353, 354 reaches the photocell 348, 349. Therefore the signals continuously given by the two photocells 348, 349 exactly define the position of the printing stylus 300 and therefore the feed back signal to supply to the driving circuits of the coils 336, 337. The photocells 348, 349 represent each one a position detecting device.

From the above description it should be evident that the movable coils 336 and 337 correspond to the coils 134 and 135 of the embodiment of FIGS. 3*a* and 3*b*, and that the electromagnet 314, 346 corresponds to the suction magnet 130. Furthermore, the position detecting devices 348, 349 (FIG. 10) correspond to the position detecting devices 126 and 127 of FIG. 3*a*. In the foregoing, the electronic control circuits of the printer will be described in connection with the embodiment of FIGS. 3*a* and 3*b*. It should be intented that the same control circuits operate in an identical manner in connection with the embodiment of FIGS. 10–12.

Figure 4A:
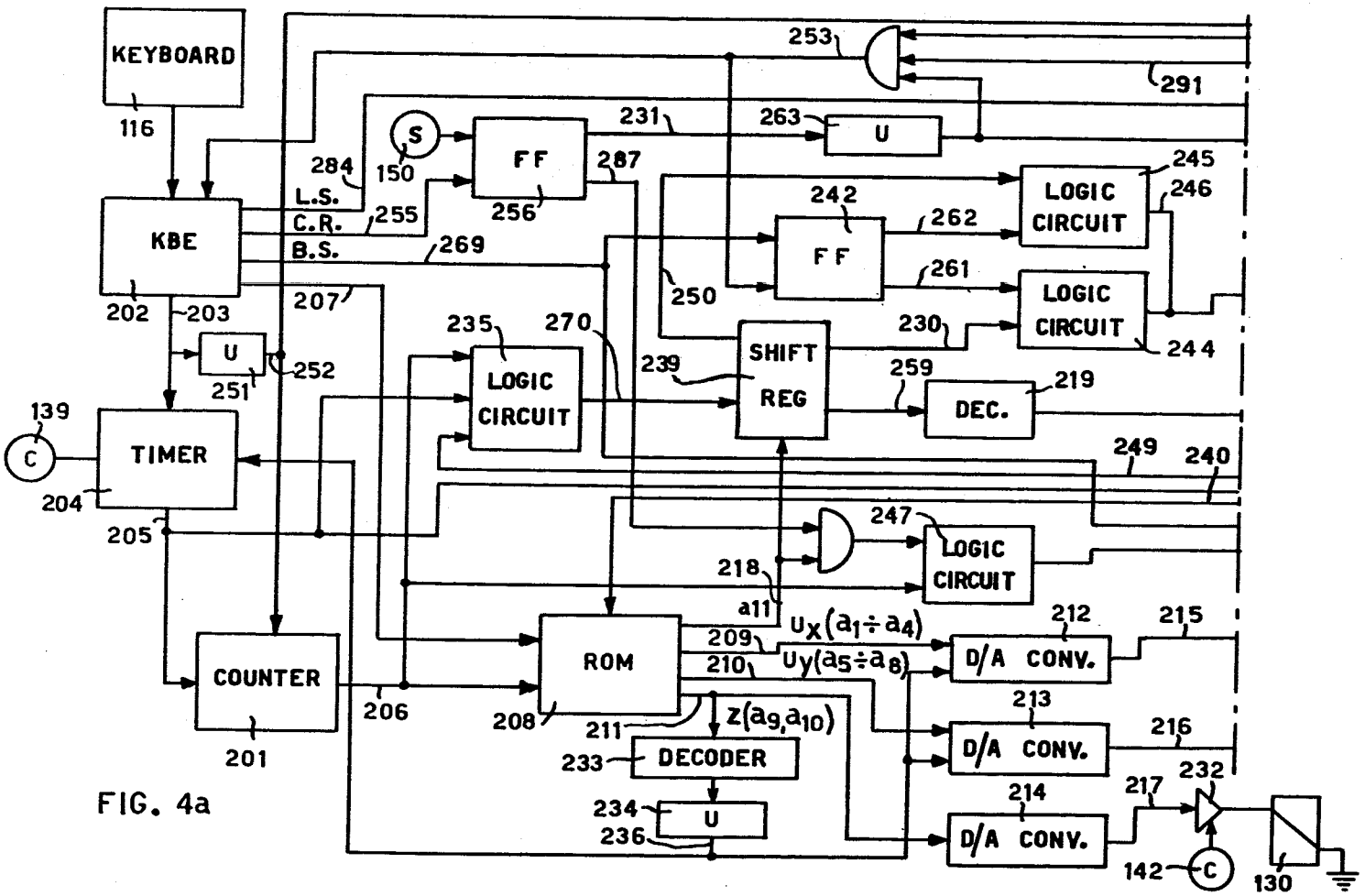
FIGS. 4*a* and 4*b* are a bock diagram of the control circuits of the printer.

The keyboard encoder 202 (FIG. 4*a*) is provided with a buffer memory, so that it can accept from the keyboard 116, the entry of characters to be printed at an instantaneous speed higher than the average speed at which the miniplotter is able to print them. With a character is set up on the keyboard 116 if the memory of the keyboard encoder 202 is unloaded or, alternatively, when a pulse on a connection 253 indicates that the preceding character has been printed if this memory is loaded, a signal appears on an output 203 of the keyboard encoder 202. This signal activates a timer 204, which is conditioned to produce on an output 205 a series of pulses, as long as the encoder 202 produces the signal on the output 203. The frequency of the pulses of the timer 204 is controlled from the console 109 (FIG. 1) by a manual control 139 operable for setting up the dimensions of the character to be printed, as will be clear later. At the same time, the appearance of the signal on the output 203 activates a univibrator circuit 251, wich generates on the output 252 a pulse, for zeroizing a counter 201, which normally receives through a connection 205 the pulses of the timer 204. The pulses of the timer 204 are also sent through the connection 205 to counting circuits 241 and 267 (FIG. 4*b*) controlling driving circuits 243 and 260 of the stepping motors 112 and 118 for letter spacing and line spacing.

The keyboard encoder 202 (FIG. 4*a*) has an output 207 for a coded signal corresponding to the character to be printed. This coded signal, together with the code generated by the counter 201 on the output 206 and indicative of its count position, forms the address of the instruction necessary for the printing of the entered character stored in read-only memory or ROM 208. These addressed instructions appear sequentially as bytes of 11 bits in parallel on outputs 209 (four bits), 210 (four bits), 211 (two bits) and 218 (one bit) of the ROM 208, at the rate established by the pulses of the timer circuit 204.

In the described embodiment the ROM 208 has a capacity of 33792 bits, and can store for each of 96 addresses corresponding to the characters settable on the keyboard 116, 352 bits, divided into 32 bytes each one of 11 bits. The ROM 208, is contained in a block 140 provided with contact terminals, inserted in the console 109 (FIG. 1) and is readily interchangeable by the operator for changing the font of the characters to be printed.

By replacing the ROM 208, (FIG. 4*a*) special signs can be printed by altering the correspondence between the keys of the keyboard 116 and the characters to be printed. For special requirements, the ROM 208 may conveniently be of the programmable type currently called a PROM. The ROM 208 may be of semiconducts type as well as magnetic, optical or of any other nature. The number and arrangement of bit contained in the ROM 208, may be different from those above described, for example for more large alphabets or for storing more than one automatically selectable alphabet.

In the example, the 11 bits, of each byte, called herein $a_1$ to $a_{11}$ are arranged as follows:

- on the output 209, the bits $a_1$, $a_2$, $a_3$, containing the coded instruction Ux relating to the speed of the pen 117 along the X axis, and the bit $a_4$ containing the instruction of the direction of this movement;
- on the output 210, the bits $a_5$, $a_6$, $a_7$, containing the instruction
- Uy relating to the speed of the pen 117 along the Y axis, and the bit $a_8$ of the direction of this movement;
- on the output 211, the bits $a_9$, $a_{10}$, containing the instruction relating to the pressure to be exerted by the pen 117 against the paper, or to its removal from the paper when it must not print;
- on the output 218, the service bit $a_{11}$, relating to the letter spacing of the carriage 110, which also is used for signalling the end of the printing operation, as is made clear hereinafter.

The coded speeds Ux, Uy along the axes X and Y and the coded data of the movement of the pen 117 along the Z axis, present on the outputs 209, 210 and 211, are converted into analog data by digital-to-analog converters 212, 213, 214 which give corresponding voltage levels Vx, Vy and Vz on connections 215, 216 and 217, respectively. The weight of the least significant bit is 0.5 volt, so that the voltages Vx and Vy can vary from zero to 3.5 volts, with a positive or negative sign according to whether the bits $a_4$ and $a_8$ are at zero or at one. The voltage Vz can vary from zero to 1.5 volts.

The voltages Vx and Vy are converted into the commands of position of the pen 117 along the X and Y axis by two integrating circuits 221 and 222, (FIG. 4*b*), comprising each one an operational amplifier 224, which transform the speed signals Vx and Vy into position signals Sx and Sy, respectively. These position signals, through two servo control circuits 219 and 220 control the position of the pen 117 along the axis X and Y. The control circuits 219 and 220 include each one a power amplifier 223 for driving the moving coils 122 and 123 of the miniplotter, and the solar cells 134 and 135 which, as already mentioned, generate a voltage proportional to the displacement of the corresponding moving coils. The voltages generated by the solar batteries 134 and 135 are applied to inputs 237 and 238 of comparison circuits 225 and 226, for effecting comparison with the corresponding voltages issuing from the integrating circuits 221 and 222. The voltages generated by the solar cells 134 and 135 are added to direct-current voltages of opposite sign generated by generators 227 and 228, respectively, with semi-fixed adjustments, in such manner that the total voltages at the inputs 237 and 238 are equal to zero when the pen 117 is positioned at the central or starting point of the character, indicated by 0 in FIG. 6.

The 32 bytes for each character permit very precise reproduction of any typographic character, even complex, both of the block capital and of the hand running type, by generating a sequence of a maximum of 31 consecutive steps or segments, the length and the orientation of which can be established in an extremely fine and precise manner. In fact, the bits $a_1$–$a_4$ (of each byte $a_1$–$a_{11}$) establish fifteen different possible values of the speed of the pen 117 along the X axis (seven to the left, seven to the right, one for no movement), and the bits $a_5$–$a_8$ establish as many values of the speed of movement along the Y axis (seven upward, seven downward, one for no movement). At the end of each time interval between two successive pulses of the timer 204, the pen 117 may be moved at the speed so defined to be precisely positioned in one of the 225 possible different positions, departing from a start position indicated by 0 in FIG. 5. These 225 positions are represented by the points of the grid as shown in FIG. 5.

The displacement of the pen 117 in each time interval depends also from the value of this interval. Therefore by altering the value of the interval the dimensions of the characters printed is altered accordingly without altering the form thereof or without changing the speed instructions recorded on the ROM 208. It is thus evident the advantage of programming the movements in terms of speed, instead of in terms of positional increments, as done in the known tracing devices. It is also evident the advantage of the printer with respect to conventional single printing head, where the printing head must be changed to change the type font.

The selector 139 (FIG. 1) of the console 109 is adapted to control the frequency of the pulses generated by the timer 204 and can be manually positioned in a positions corresponding to the printing of 1/12" ("elite") characters and 1/10" ("pica") characters, as well as in positions corresponding to the printing of narrower and wider characters. An example of printing of similar characters with different dimensions obtained by adjusting the selector 139 is given in FIG. 7*a*. The adjustment of amplitude may be obtained alternatively by adjusting the amplitude of the command signals of the servo control circuits 219 and 220 (FIG. 4*b*), for example by means of potentiometers connected in the outputs of integrators 221 and 222. In both cases by acting differently on the commands of the control circuits 219 and 220, it is also possible to alter the proportions between height and width of the printed character at will, without any additional instruction of the ROM 208.

A signal attenuator 229 is provided between the integrator 221 and the circuit 222 to attenuate the signal Sy with respect to the corresponding signal Sx to take account of the inequality of elements 159 and 160 (FIG. 3*a*), carrying the pen 117, in such manner that the effective movement of the pen along the X and Y axes is the same, for an equal signal issuing from the integrating circuits 221 and 222. The attenuator 229 is however superfluous for the embodiment of FIGS. 10–12, since the arms of the frame 221 have equal length.

Figures 8A, 8B, 8C, 8D, 8E:
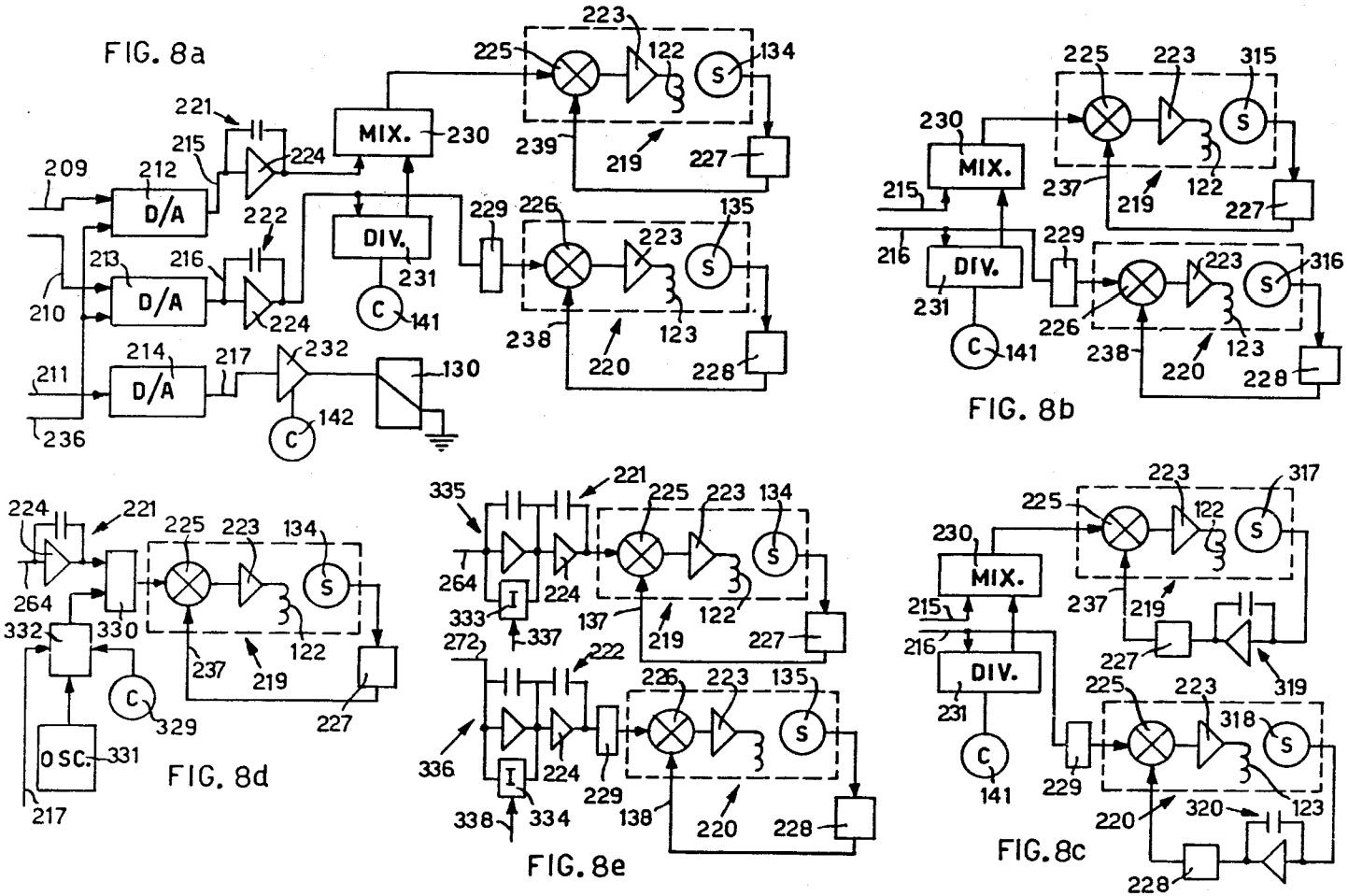
FIGS. 8*a* to 8*e* show a number of modifications in the diagram of FIG. 4.

A mixing circuit 230 (FIG. 4*b*), connected in the input 264 of the integrator 221, adds to the signals Vx of the X axis a fraction of the signal Vy of the Y axis, which is determined by a dividing circuit 231 adjustable by a manual control 141 (FIG. 1) of the console 109. Consequently a shifting along the X axis proportional to the instanteneous value of this deviation can be produced and therefore a sloped character is printed, with a degree of inclination adjustable by means of the control 141. This slope is nil if the dividing circuit 231 (FIG. 4*b*) does not send any voltage to the mixing circuit 230, and increases as this voltage is increased. An example of sloping the characters of FIG. 7*a* is given in FIG. 7*b*. The mixing circuit 230 (FIG. 4*b*) and the dividing circuit 231 may likewise be located downstream of the integrating circuits 221 and 222, as indicated by the diagram of FIG. 8a, which is a modification of a part of the diagram of FIG. 4.

FIG. 6 shows as an example the character "R", with the corresponding grid adapted to clarify the method of programming. In this figure the black dots marked by serial numbers indicate the points of arrival of the segments successively covered by the pen 117 in plotting the character, according to the corresponding instructions given by the ROM 208. The dashed lines correspond to the distances covered with the point 119 not in contacting the paper.

The programs stored in the ROM 208 for the capital "R" is given in the following TABLE which indicates the bits $a_1$–$a_{11}$ given by the ROM 208 on the outputs 209, 210, 211, 218 (FIG. 4a), for the bytes of the successive positions corresponding to the counting of pulses of the counter 201. The columns Ux, Uy, Z of the table indicate the relative numercial values of the speeds of the consequent displacements along the X and Y axes, and of the command along the Z axis, corresponding to the various positions shown on FIG. 6. The movement of the pen 117 to the left and downwardly is indicated as negative (bits $a_4$ and $a_8 = 0$) and the movement in the opposite directions is indicated as positive (bits $a_4$ and $a_8 = 1$).

As will be made clear hereinafter, in the first three bytes the first bit $a_{11}$ specifies the directions of advance of the carriage 110 (1 = from left to right); the second and third of these bits $a_{11}$ specify the four possible values of differentiated spacing of 0, 4, 6, 8 elementary steps of the stepping motor 112; the bit $a_{11}$ of the 31st group indicates the end of the operation of plotting the character.

TABLE

| Group | $U_x$ | $U_y$ | Z | $a_1$ | $a_2$ | $a_3$ | $a_4$ | $a_5$ | $a_6$ | $a_7$ | $a_8$ | $a_9$ | $a_{10}$ | $a_{11}$ |
|---|---|---|---|---|---|---|---|---|---|---|---|---|---|---|
| 1 | −7 | +5 | 0 | 1 | 1 | 1 | 0 | 1 | 0 | 1 | 1 | 0 | 0 | 1 |
| 2 | −1 | +5 | 0 | 0 | 0 | 1 | 0 | 1 | 0 | 1 | 1 | 0 | 0 | 0 |
| 3 | +3 | 0 | 1 | 0 | 1 | 1 | 1 | 0 | 0 | 0 | 0 | 0 | 1 | 1 |
| 4 | +3 | 0 | 1 | 0 | 1 | 1 | 1 | 0 | 0 | 0 | 0 | 1 | 0 | |
| 5 | +3 | 0 | 2 | 0 | 1 | 1 | 1 | 0 | 0 | 0 | 0 | 1 | 0 | 0 |
| 6 | +3 | −1 | 2 | 0 | 1 | 1 | 1 | 0 | 0 | 1 | 0 | 1 | 0 | 0 |
| 7 | +1 | −1 | 3 | 0 | 0 | 1 | 1 | 0 | 0 | 1 | 0 | 1 | 1 | 0 |
| 8 | +1 | −2 | 3 | 0 | 0 | 1 | 1 | 0 | 1 | 0 | 0 | 1 | 1 | 0 |
| 9 | 0 | −3 | 3 | 0 | 0 | 0 | 0 | 0 | 1 | 1 | 0 | 1 | 1 | 0 |
| 10 | −1 | −2 | 3 | 0 | 0 | 1 | 0 | 0 | 1 | 0 | 0 | 1 | 1 | 0 |
| 11 | −1 | −1 | 3 | 0 | 0 | 1 | 0 | 0 | 0 | 1 | 0 | 1 | 1 | 0 |
| 12 | −3 | −1 | 2 | 0 | 1 | 1 | 0 | 0 | 0 | 1 | 0 | 1 | 0 | 0 |
| 13 | −3 | 0 | 1 | 0 | 1 | 1 | 0 | 0 | 0 | 0 | 0 | 0 | 1 | 0 |
| 14 | −3 | 0 | 1 | 0 | 1 | 1 | 0 | 0 | 0 | 0 | 0 | 0 | 1 | 0 |
| 15 | +3 | 0 | 1 | 0 | 1 | 1 | 1 | 0 | 0 | 0 | 0 | 0 | 1 | 0 |
| 16 | +3 | −2 | 2 | 0 | 1 | 1 | 1 | 0 | 1 | 0 | 0 | 1 | 0 | 0 |
| 17 | +2 | −2 | 2 | 0 | 1 | 0 | 1 | 0 | 1 | 0 | 0 | 1 | 0 | 0 |
| 18 | +2 | −3 | 3 | 0 | 1 | 0 | 1 | 0 | 1 | 1 | 0 | 1 | 1 | 0 |
| 19 | +2 | −3 | 3 | 0 | 1 | 0 | 1 | 0 | 1 | 1 | 0 | 1 | 1 | 0 |
| 20 | +2 | 0 | 2 | 0 | 1 | 0 | 1 | 0 | 0 | 0 | 0 | 1 | 0 | 0 |
| 21 | −5 | 0 | 0 | 1 | 0 | 1 | 0 | 0 | 0 | 0 | 0 | 0 | 0 | 0 |
| 22 | −5 | 0 | 0 | 1 | 0 | 1 | 0 | 0 | 0 | 0 | 0 | 0 | 0 | 0 |
| 23 | −5 | 0 | 2 | 1 | 0 | 1 | 0 | 0 | 0 | 0 | 0 | 1 | 0 | 0 |
| 24 | +2 | 0 | 2 | 0 | 1 | 0 | 1 | 0 | 0 | 0 | 0 | 1 | 0 | 0 |
| 25 | 0 | +5 | 3 | 0 | 0 | 0 | 0 | 1 | 0 | 1 | 1 | 1 | 1 | 0 |
| 26 | 0 | +5 | 3 | 0 | 0 | 0 | 0 | 1 | 0 | 1 | 1 | 1 | 1 | 0 |
| 27 | 0 | +5 | 3 | 0 | 0 | 0 | 0 | 1 | 0 | 1 | 1 | 1 | 1 | 0 |
| 28 | 0 | +6 | 3 | 0 | 0 | 0 | 0 | 1 | 1 | 0 | 1 | 1 | 1 | 0 |
| 29 | +3 | −6 | 0 | 0 | 1 | 1 | 1 | 1 | 1 | 0 | 0 | 0 | 0 | 0 |
| 30 | +2 | −6 | 0 | 0 | 1 | 0 | 1 | 1 | 0 | 1 | 0 | 0 | 0 | 0 |
| 31 | 0 | 0 | 0 | 0 | 0 | 0 | 0 | 0 | 0 | 0 | 0 | 0 | 0 | 1 |

The bits $a_9$ and $a_{10}$ are converted at the output of the digital-to-analog converter 214 (FIG. 4*a*) into analog control voltages for a power amplifier 232 driving the suction electromagnet 130. If the two bits $a_9$ and $a_{10}$ are both at zero, the electromagnet 130 is deenergized and the point 119 of the pen 117 is not in contact with the paper. If the two bits $a_9$ and $a_{10}$ are not both at zero, the electromagnet 130 can be energized by the three different values of current, corresponding to the value of the two bits, to thrust the point 119 against the paper with three corresponding values of pressure. It is thus posssible to obtain three different intensities of printing or thickness of the sign forming the same character, as is apparent from FIG. 6.

A decoder 233 (FIG. 4*a*) is adapted to recognize the presence of at least one of the two bits $a_9$ and $a_{10}$ on the output 211 of the ROM 208.

The bits $a_9$ and $a_{10}$ indicative of the movement of the pen 117 from the inoperative position to contact the paper and vice versa cause the decoder 233 to start a univibrator 234, which via a connection 236, delays the generation of the pulses by the timer 204 of about 3 milliseconds, and temporarily zeroizes the outputs of the digital-to-analog convertes 212 and 213, whereby during the movement of the pen 117 (FIG. 3*b*) from the inoperative position to the printing position and vice-versa the movements of the pen 117 along the X and Y axes are temporarily suspended, thus avoiding indefiniteness and blurring in the printing of the character.

A manual control 142 (FIG. 1) on the console 109 is operable to alter the supply voltage of the suction electromagnet 130, whereby it permit adjustment of the force exerted by the electromagnet 130 as a function of the desired intensity of printing and of the number of copies. It is thus possible to print selectively bold faced characters or part of the text. The same commands obtained from the manual selector 139, (FIG. 1) and controls 141 and 142 of the console 109, may be replaced by electric commands originating from a computer or from any other data processing system, or even be contained in possible supplementary instructions of the same ROM 208 or of another storing means.

It is likewise possible to underline or accent the characters automatically, on command from the console or electric signal, by providing in the ROM 208 (FIG. 4*a*) the instructions relating to the underlining or the accent, to be executed automatically under a specific command immediately following those relating to the printing of any character coming from the ROM 208.

The bit $a_{11}$ of each byte is also used for supplying the information relating to the extent of letter spacing, which is differentiated, that is proportional to the width of the individual character. More particularly, three different values of the letter spacing are provided; a minimum for narrow characters such as i, medium for medium characters such as o, and maximum for large characters such as m. The three letter spacing movements correspond to advance of the stepping motor 112 by 4, 6 and 8 steps, respectively. The information relating to the letter spacing allotted to the individual character is carried in coded form by the first three service bits $a_{11}$, relating to each character to be printed. These bits are stored on a shift register 239 formed of three storage cells. The register 239 is adapted to receive pulses of the timer 204 applied to an input 270 and conditioned by a logic circuit 235. This latter is controlled by the output 206 of the counter 201 and the output 249 of a bistable circuit 248 to allow the passage of only the first three pulses of the timer 204. It is thus clear that at the end of the first three pulses of the timer 204. The shift register 239 preserves in its three cells the information of the letter spacing of the carriage 110 carried by the bits $a_{11}$ of the first three groups of bits.

Figures 4, 4B:
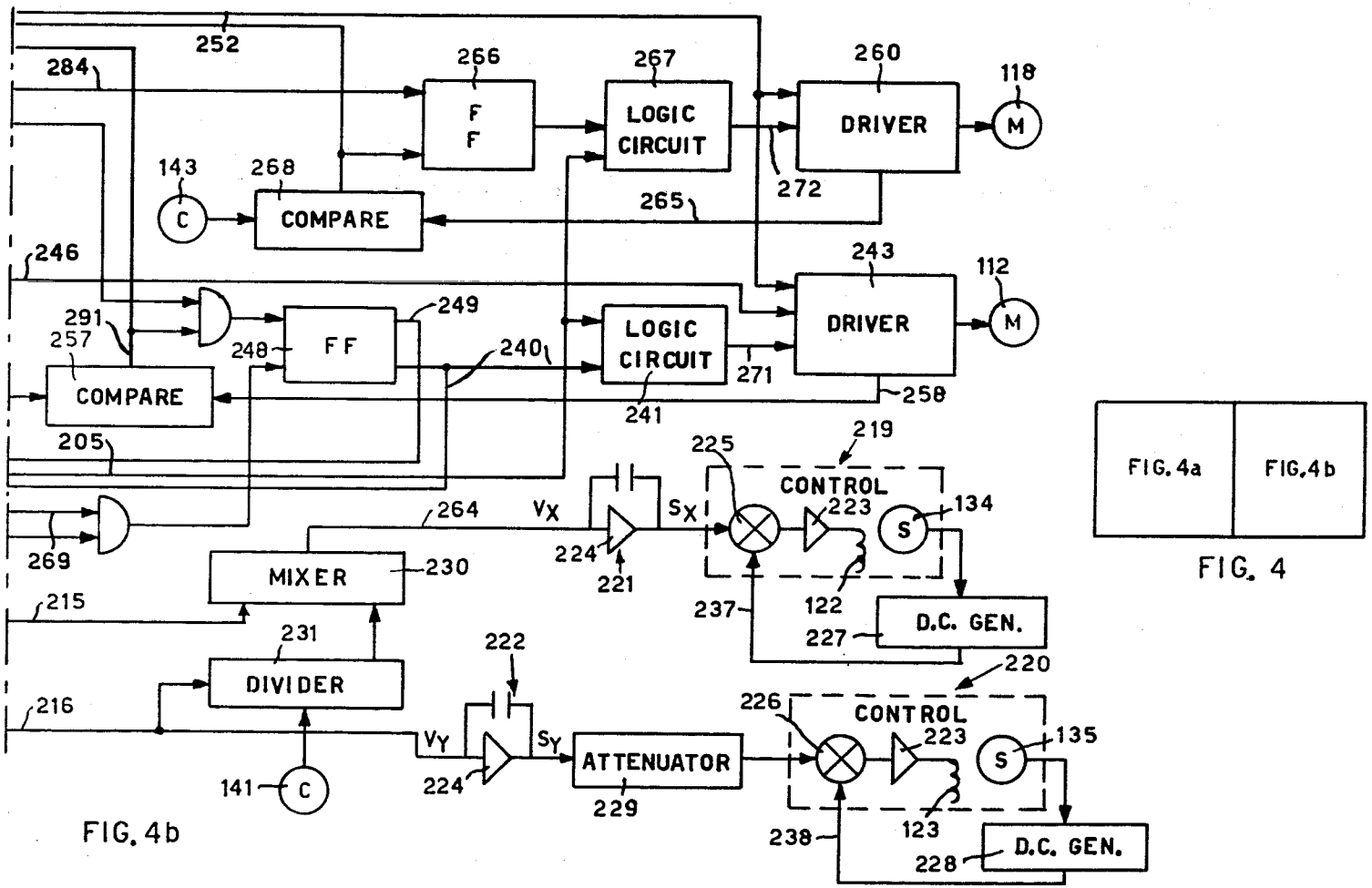

The letter spacing is started by a service bit $a_{11}$ of the last byte of a character subsequent to the first three bytes appearing on the output 218 of the ROM 208 and indicating that the plotting the character has been finished. In the example given in FIG. 6 and in the table this bit appears in the 31st byte. This bit $a_{11}$ is recognized by a logic circuit 247 (FIG. 4*a*) which, if the counter 201 is in a count position higher than three, and through an OR gate, sets the flip-flop 248 (FIG. 4b). Through a connection 240, the flip-flop 248 blocks the counter 201 in the position reached and causes the motor 112 to rotate for letter spacing the carriage 110, by enabling the counting circuit 241 to allow the passage of the pulses of the timer 204 to an input 271 of the driving circuit 243.

The extent of this letter spacing and the direction of movement are determined by the data stored in the cells of the shift register 239. More particularly, two outputs 230 and 250 (FIG. 4a) of the shift register 239 carry the bit $a_{11}$ of the first byte relating to the direction of advance of the carriage 110, to the left or right, to two logic circuits 244 and 245 which are respectively conditioned by two outputs 261 and 262 of a flip-flop 242. If the flip-flop 242 is in a first condition, it enables the logic circuits 244 and 245 to allow this bit $a_{11}$ of output 230, to pass on a control connection 246, for selecting the direction of advance of the stepping motor 112. For Latin alphabet the bit $a_{11}$ is provided as to cause the carriage 110 to be letter spaced rightwards; for Arabic and similar alphabets the bit $a_{11}$ is provided of opposite value, to cause the carriage to be letter spaced leftwards.

The stepping motor 112 rotates one step, at each pulse which arrives through the logic circuit 241. The number of steps performed from the beginning of the advance appears in coded form on an output 258 and is compared by a comparison circuit 257 with the number of unity steps provided for the character, which is carried by the bits $a_{11}$ of the second and third bytes, also stored by the shift register 239 and decoded by a decoder 219 into codes corresponding to 0, 4, 6 or 8 unity steps. When the equality is recognized by the comparison circuit 257, it generates on the output 291 a signal which, through an OR gate, resets the flip-flop 248, thus arresting the rotation of the stepping motor 112. In addition, this signal through another OR gate and the connection 253 causes the following character, possibly stored on the accumulating memory of the keyboard encoder 202 to be printed.

The extent of the movement of the carriage 110 (FIG. 2) for each character is determined, apart from the number of steps effected by the stepping motor 112, by the condition of the speed change device 120. Through a tie rod 147 and a lever 148, the device 120 is controlled by the selector 139 of the size of the character which thus selects in each of its positions the ratio of speed of the device 120 corresponding to the selected size of the character. More particularly, in the case of "elite" character, the letter spaces are 1/18", 1/12" and 1/9", respectively for the characters requiring respectively 4, 6 and 8 unity steps. These letter spaced are multiplied by a factor of 1.2 for "pica" characters, and in proportion for the other sizes.

The carriage return key of the keyboard 116 when depressed, in addition to the corresponding code appearing on the output 207 (FIG. 4*a*) of the encoder 202, causes a pulse to appear on an output 255 to position a flip-flop 256, bringing an output 287 to high level. After the counter 201 has counted the first three pulses, this level allows the logic circuit 247 to position the flip-flop 248 (FIG. 4*b*). This latter enables the logic circuit 241 to allow the pulses of the timer 204 to pass the input 271 of the driving circuit 243 of the stepping motor 112. The return movement of the carriage 110 is thus effected in the direction indicated by the bit $a_{11}$ of the first byte relating to the carriage return operation, which appears on the output 230 (FIG. 4*a*) of the shift register 239. As long as the flip-flop 248 is positioned by the flip-flop 256, it prevents the arrest of the movement of the carriage by the action of the comparison circuit 257. The return movement of the carriage 110 continues until a sensor 150 of the left-hand margin of the carriage 110 resets the flip-flop 256. Then, the flip-flop 256, through a pulse of a univibrator 263, connected to an output 231 and an OR gate, resets the flip-flop 248 (FIG. 4*b*), and therefore blocks the passage of the pulses of the input 271 of the circuit 243 and, through the connection 253 (FIG. 4*a*) signals to the keyboard encoder 202 the completion of the carriage return, thus calling the next following character therefrom.

The back spacing key of the keyboard 116, when depressed, causes a pulse to appear on an output 269 of the keyboard encoder 202 and sets the flip-flops 242 and 248, which allow the passage of the pulses of the timer 204 to the input 271 (FIG. 4*b*) of the driving circuit 243 of the stepping motor 112. Through the connection 249 with the logic circuit 235 (FIG. 4a), which is at low level, the flip-flop 248 blocks now the passage of the pulses of the timer 204 to the shift register 239, so that this preserves the spacing datum previously stored. The flip-flop 242 causes the exchange of levels between the outputs 261 and 262 of the flip-flop 242 and through the logic circuits 244 and 245, and the connection 246 causes the driving circuit 243 to reverse the direction of movement of the carriage 110, with respect to the letter spacing direction. Thus the carriage 110 is back spaced a number of steps corresponding to the instructions stored in the shift register 239, which relates to the previous printer character. At the end of such number of steps, the comparison circuit 257 resets the flip-flop 248, thus arresting the carriage 110, and, through the connection 253, resets the flip-flop 242 and calls the following character from the keyboard encoder 202.

The storage of the number of steps of the previous letter spacing on the register 239 is particularly useful for correction of wrongly printed characters. Such a correction is effected by repeating with precision the plotting of the character to be erased upon having interposed an obliterating ribbon or strip between the printing point 119 and the paper, for example a so called lift-off ribbon or a so called cover up ribbon. The entire correction operation consisting of the carriage back space and erasure operations together, can be controlled by a logic circuit adapted to cause the pen 117 to cover again automatically the path followed in the printing of the character to be erased, said circuit being also adapted to select and interpose such an obliterating ribbon.

The stepping motor 118 (FIG. 4*b*) produces the line spacing of the paper under the control of the driving circuit 260. The line spacing is defined by the manual selector 143 on the console 109, which determines the number of steps that the motor 118 must perform. When the keyboard encoder 202 emits the line spacing code, a pulse appears on an output 284. This pulse sets a flip-flop 266 which enables a logic circuit 267 to allow the pulses of the timer 204 to pass to an input 272 of the driving circuit 260 of the stepping motor 118. The movement stops when a comparison circuit 268 recognizes equality between the steps executed, carried back in coded form on a connection 265, and the steps set by the selector 143. On recognition of equality, the comparison circuit 268 resets the flip-flop 266 and signals the completion of the line spacing on the connection 253. The amount of the line spacing can also be linked automatically with the dimensions of the printed character defined by the selector 139, in a manner similar to that described with regard to the letter space of the carriage 110.

In the embodiment, all the entries on the keyboard, including relating to space bar and carriage return, with the sole exception of the line spacing, are carried out by instructions contained in the ROM 208. This solution gives the electronic typewriter the maximum flexibility of use, allowing the same machine, for example, to type or print equally well from left to right or in the opposite direction, by mere replacement of the ROM 208, which defines the set of characters corresponding to the keyboard, so that the same machine is adapted to print equally well, for example, Latin and Arabic characters.

It is clear that various modifications can be made to the described printer. For example the ROM can have cells of different capacity, or a plurality of cells can be used for the same character, for example, for some Chinese ideograms. On the contrary the same cell can be used for containing the data relating to a plurality of very simple characters, such as, for example, the stop, the dash or hyphen, the comma, etc. with some additional address signals for the ROM 208.

The described printer effects a quite silent operation at a printing speed is of about 20 characters per second, which is completely satisfactory for an office typewriter teleprinters and terminals as well as for automatic printing or word processing systems. The actual value of the printing speed depends on the form of the characters printed, on the degree of accuracy with which it is desired to reproduce the design thereof, on the dimensions of the character, and on the possible introduction of electrical or mechanical damping devices into the control circuits 219 and 220. More particularly, in the embodiment the frequency of the pulse generated by the timer 204 is 600/sec. for the "elite" character, corresponding to an interval of 1.33 ms between the pulses. This interval must be multiplied by a factor of 1.2 for the "pica" character.

For the conventional Latin characters, the average number of bytes required for printing one character is around 20. To these bytes, on the average other six pulses must be added for letter spacing the carriage 110 plus the delays introduced by the univibrator 234 to take account of the times of lowering and raising of the point 119 of the pen 117. Since, at the end of the letter spacing, the printing of the following character may begin immediately, the printing of an "elite" character requires on the average about 50 ms, which corresponds to the average speed of 20 characters/sec.

From the above description it should be evident that the printer with single tracing element controlled with the control of FIG. 4 is adapted to advantageously solve a lot of printing problems, for example the change of type fonts both as sizes and as style, the change of the basic spacings, the use of a proportional letter spacing. This latter can be provided with even a very high number of different spacings for the various characters, rather that the three different spacings as disclosed by way of example in the embodiment of FIG. 4.

Particularly, the printer is adapted to trace out any sign departing from a set of velocity instructions corresponding to a set of segments to be traced on the paper by the printing element. Other instructions relating to the same segments of the character can define the thickness of the sign in each part thereof. All these instructions are arranged in the ROM 208 in form of routines addressed by input signals entered for example from a keyboard or any other input device.

As already mentioned such a printer is particularly adapted for printing a text in a languages having any kind of alphabet, including the Greek, the Cyrillic, the Jewish, the Armenian, the Hindi, the Sinhalese, the Katakana. The alphabet can be automatically selected by controls in the keyboard, in the case the ROM 208 is enough large to store more then one alphabet. In alternative the ROM 208 can be easily replaced in the box 140. In both cases the keyboard can be provided with any suitable means, such as a removable cover sheet or like, for indicating to the operator the specific keyboard layout for each alphabet. The printer is also specifically suitable for all characters of the Italic or running hand type, particularly for the group of Arabic alphabets, such as the Urdu, Pharsi, Afghan etc., which require that the various characters of a word be linked to each other and have signs of a continuously variable thickness.

In these languages the letters of the alphabet can assume a different shape according to whether they are isolated, or at the beginning, in the middle, or at the end of a word. Furthermore the linkage between letters must be defined according to the shape of the two adjacent letters. Finally there are composite characters which result by a combination of two or more letters. To take into account all these situations in the conventional typewriters and typographic machines, several standards for the characters of the alphabet have been proposed. Such standards aim to reduce the number of different forms of each character so as to directly select them from a conventional keyboard, which normally has from 42 to 46 printing keys. The result is that the text could suffer both is clearness when is read, and in the asethetics. Even if it has been proposed to have additional printing characters with respect to those provided directly by the keyboard, for example by selecting them according to a sequence of at least three characters, with the exclusion of the mosaic or dot printers, it is always necessary to provide for a very high number of different character type faces. On the contrary, with the printer having a single tracing element all these characters can be obtained according to additional instructions stored in the ROM 208 and addressed by specific logic circuits.

The above described printer is also particularly adapted for printing a text in a language using ideograms rather than alphabetic characters, such as the Chinese, the Japanese, the Kanji and similar languages. Since the instructions of each character are addressed in the memory by electronic signals, it is possible to address the entire ideogram according to a combination or to a sequence of input data suitably coded.

The movements of the pen 117 (FIG. 3*a*) or the stylus 300 (FIG. 10) can be controlled by control circuits having a number of possible modifications with respect to the basic circuit diagram of FIG. 4.

In FIGS. 8*b* and 8*c* the integrators 221 and 222 of FIG. 4*b* are not used. Two speed detectors 315 and 316 (FIG. 8*b*) and respectively two acceleration detectors 317 and 318 (FIG. 8*c*) followed by integrating circuits 319 and 320, are used instead of position detectors 134 and 135 of FIG. 4. In both cases the comparison in the circuits 225 and 226 of the servos 219 and 220 is made in terms of speed, instead of position.

To print characters in bold face, a high frequency signal of about 20 kHz may be produced by an oscillator 331 (FIG. 8*d*) and superimposed to the signals of the control connection 264 of the X axis, for example through an adding circuit 330, as shown in FIG. 8*d*, for the control of the movement of the pen 117 along the X axis. The amplitude of this high-frequency signal can be defined, for example, by a modulating circuit 332 controlled by the signals of the output 217 of the digital-to-analog converter 214 (FIG. 8*a*) for the Z axis, in combination with a manual control 329 (FIG. 8*d*).

The number of rectilinear segments required for each character can be reduced by replacing a group of segments by curvilinear portions, for example parabola segments. To this end, supplementary integrators 335 and 336 (FIG. 8*e*) can be provided in the X and Y channels. Logic circuits 333 and 334, by means of coded signals on the connections 337 and 338, selectively cause the supplementary integrators 335 and 336 to be inserted in the control circuits 219 and 220 for the parabola segments or to be short circuited for the rectilinear segments.

The letter spacing of the carriage 110, instead of being successive to the plotting of the character, may be simultaneous therewith, with a consequent increase in the printing speed. In the programming of the movements of the pen 117, account has to be taken of the fact that the actual movement of the pen 117 with respect to the paper results from the sum of its movement with respect to the carriage 110 and of the movement of the carriage 110 with respect to the paper. For compensating any irregularities in the speed of carriage 110 during the advance controlled by the stepping motor 112, the detector 134 of the control circuit 219 should refer to the absolute position of the pen 117 with respect to the paper, instead of to the carriage 110 only. To this end, a potentiometer position detector can be used. This may be a detector fixed to the side walls 101 or 102 to follow the pen 117 in all its movement with respect to these side walls, or a detector for detecting the movement of the carriage 110 which superimposes its indication on that of the detector 134 of the movement of the pen 117 with respect to the carriage 110. No additional detector is required, if an accelerometric detector 317 (FIG. 8*c*) is used, for example a detector of inertial type.

Similarly the movement of the pen 117 in the vertical direction and the rotation of the platen 103 can be summed up, to use the electronic typewriter, as a very accurate plotter. To this end the coded instructions on the ROM 208 are replaced by speed instructions relating to the graphs and figures to be plotted and issuing, for example, from a computer. The described electronic typewriter can be used as a plotter, also by generating by the computer separately the instructions relating to the letter spacing and line spacing movements of the carriage 110 and those relating to the plotting operations that the pen 117 must execute between one of these movements and another.

Particularly in view of the use as a plotter, it may be useful to add a control, for example a change-over switch on the console 109, which exchanges with one another the connections of the moving coils 122 and 123 relating to the movement of the pen 117 along the X and Y axes, and at the same time the connections of the advance stepping motor 112 and of the line spacing stepping motor 118, so that, instead of the printing of the characters in the horizontal direction, it is print in the vertical direction, with a rotation of 90 degrees, as required for printing dimensions on graphs and drawings.

The printer can also be fixed with respect to the side walls 101 and 102 and the platen 103 with the paper can be transversely movable with respect to the pen 117. Also the printer can be provided with mechanical, electrical or electronic tabulating devices in the horizontal and vertical directions, these devices being set manually or by stored data.

According to another modification of the described printer, the instructions for printing each character can provide that the pen 117 shifts from the left of the matrix to the right end of the matrix of the character (points $X_1$ and $X_2$, FIG. 6) rather than from to central point 0–30 back to the same point. In this case, the carriage 110 is standing during the printing, for example locked by an electromagnet. At the end of the plotting of the character, the carriage is unlocked, while on the other hand the position of the pen 117 with respect to the guide 104 remains stationary. The instructions for returning the pen 117 to the starting point ($X_1$, FIG. 6) cause the movement of the pen 117 with respect to the carriage 110, and the shifting of the carriage 110 with respect to the paper, by an amount equal to the required letter space. If, during this movement the force of a carriage advancing pre-loaded spring is overcome, the carriage 110 is returned to the beginning of the line by unlocking the carriage 110 while returning the pen 117 to $X_1$ position.

What I claim is:

1. An electronic printer having a single tracing element for tracing alphanumeric characters, comprising spacing means for relatively moving said tracing element and the paper in a letter spacing relationship, driving means for shifting said tracing element along a pair of coordinates parallel to the printing plane independently of the said letter spacing, for tracing each character, storing means for storing a set of addressable numerical instructions for each one of said characters, addressing means conditionable for sequentially addressing the instructions of a predetermined character, printing control means operable for conditioning said driving means according to a character to be printed, detecting means for detecting the position of said tracing element, D/A converting means for converting the numerical instructions so addressed into command signals, comparison means for comparing the signals given by said detecting means and by said converting means, and servo control means conditioned by said comparison means for controlling said driving means.

2. A printer according to claim 1, wherein said instructions define the speed of said element in a predetermined interval of time along said coordinates, and comprising a pair of control circuits included in said control means for controlling said driving means, integrating means connected to said control circuits, detecting means included in said servo control means for detecting the position of the said tracing element, and comparison means for comparing the signals of said detecting means and the singals corresponding to said instructions.

3. A printer according to claim 4, wherein said storing means include a read only memory where the instructions for tracing each character are stored in form of a routine addressable by coded input signals, comprising a counter conditionable by said input signals for starting to count, and means for causing said addressing means to address the subsequent instructions of each routine by supplementing said input signals with the counting signals of said counter.

4. A printer according to claim 3, wherein the routine of each address contains the instructions relating to more than one character.

5. A printer according to claim 3, wherein said routines are of a length variable according to the complexity of each character.

6. A printer according to claim 3, wherein said read-only memory is of programmable type.

7. A printer according to claim 3, wherein each one of said routines includes a plurality of bytes, each byte having a pair of portions for controlling the tracing movement of said element for each segment of character along said coordinates, each one of said portions comprising an indication of the value of the speed of said segment for conditioning an associated one of said control circuits and an indication of the direction of movement for conditioning direction control means associated with said control circuits.

8. A printer according to claim 7, wherein each one of said bytes comprises also at least one bit, the sequence of a predetermined number of said bits in subsequent bytes controlling said spacing means for defining the letter spacing of the character being traced, and comprising a shift register for storing said predetermined number of bits during the tracing of a character, said shift register being cleared upon addressing the instructions of a subsequent character.

9. A printer according to claim 8, wherein the last byte of each character includes an indication of the end of routine, recognition means being provided for causing said input means to address the next input signal to said memory in response to the indication of said end of routine.

10. A printer according to claim 7, comprising adjusting means for varying the action of the said speed instructions on the said integrating means to print characters of different form departing from the said speed instructions.

11. A printer according to claim 7, including a cyclical timer having a cycle defining said interval of time, said timer controlling said integrating means, and a control member operable for adjusting the cycle of said timer, whereby the size of the characters to be printed is accordingly adjusted.

12. A printer according to claim 7, including combining means conditionable for combining the signal of the indication of speed controlling the movement of the tracing element along one coordinate to the signal of the indication controlling the movement of the tracing element along the other coordinate, and control means operable for variably adjusting said combining means, whereby the characters will be traced with a corresponding slope in respect of said coordinates.

13. A printer according to claim 12, wherein said combining means comprise a signal divider controlled by said control means, and a signal mixer for mixing the output of said signal divider with the signal of said other coordinate.

14. A printer according to claim 7, comprising means for adding to a command signal generated by the said speed instructions for one coordinate, an adjustable signal proportional to the command signal generated by said speed instructions for the other coordinate, whereby the character will be traced with a corresponding slope from the same speed instructions.

15. A printer according to claim 7, comprising a third control circuit for causing said tracing element to trace a sign with a selectable thickness, said byte including a third portion for selecting said thickness and accordingly controlling said third control circuit.

16. A printer according to claim 15, comprising high frequency means conditionable by said third control circuit to superimpose selectively a high frequency movement to the command of the said tracing element along one of the said coordinates to print bold face characters, and control means for adjusting the operation of said high frequency means to adjust the thickness of the bold face characters.

17. A printer according to claim 7, comprising adjusting means for varying the action of said speed instructions on the said integrating means to print characters of different size departing from the said speed instructions.

18. An electronic printer having a single tracing element for tracing alphanumeric characters, comprising spacing means for relatively moving said tracing element and the paper in a letter spacing relationship, storing means for storing addressable numerical instructions for each one of said characters, addressing means for addressing each time the instructions of a predetermined character, control means conditioned by said addressed instructions, driving means controlled by said control means for driving a pair of electromagnets each having a movable member, and kinematic means supporting said tracing element and connected to said movable members for converting the movements of the said two movable members into the movements of said tracing element along a pair of coordinates, said kinematic means comprising a group of hinged arms, the hinges of which are formed by flexible leaf springs.

19. A printer according to claim 18, wherein said electromagnets are of the moving coil type and comprise a common permanent magnet.

20. A printer according to claim 18, wherein said kinematic means comprise for the two coordinates at least two unequal arms, whereby an equal movement of the said movable members produces an unequal movement of said printing element along the two coordinates.

21. A printer according to claim 19, wherein said kinematic means comprise a hinged frame having four arms of equal length and parallel to the direction of either coordinates of movement of said tracing element, said tracing element being mounted on a first vertex of said frame, another vertex opposite to said first vertex of said frame being fitted in a carrying structure, said moving coils being connected to the two arms adjacent said opposite vertex.

22. A printer according to claim 21, wherein the hinges of said frame are formed by elastically flexible portions of said arms.

23. A printer according to claim 18, wherein said tracing element comprises a pen including an ink reservoir, the printing being effected by pressing said pen against the paper.

24. A printer according to claim 18, wherein said tracing element comprises a movable ink jet nozzle.

25. A printer according to claim 19, wherein said tracing element comprises a stylus, the printing being effected by the pressure exerted by the said stylus against the paper.

26. A printer according to claim 19, wherein said tracing element includes a stylus, comprising moving means for moving the said stylus in a direction perpendicular to the paper under the control of numerical instructions, said moving means moving said stylus away from the paper when no sign is to be traced and being conditioned to vary the intensity of the printed sign by altering the pressure exerted against the paper according to said instructions.

27. A printer according to claim 26, comprising a thickness control member operable for adjusting the pressure exerted by the said stylus against the paper in addition to said numerical instructions, in order to vary the intensity of the printing.

28. A printer according to claim 26, wherein said moving means comprises another arm fitted at one of its ends and provided with an elastically flexible portion, the other end of said other arm being rigidly connected with said stylus.

29. A printer according to claim 28, wherein said moving means comprise a third moving coil connected to said other arm and variably energizable for moving said stylus perpendicularly to the directions of said coordinates.

30. A printer according to claim 29, wherein said moving coils are each one shiftable coaxially with a corresponding magnetic core, the three cores being magnetically connected to said permanent magnet.

31. A printer according to claim 18, comprising servo control means conditionable by the addressed instructions and by means for detecting the movement of said tracing element for controlling said driving means, and a portion of two arms of said kinematic means for being continuously detected by said detecting means.

32. A printer according to claim 31, wherein said detecting means are adapted to detect both the tracing and letter spacing movements of the tracing element with respect to the paper to control said servo control means, whereby the said letter spacing is effected simultaneously with the printing.

33. printer according to claim 18, wherein the said tracing element is carried by a carriage slidable parallel to the direction of printing, said spacing means keeping said carriage locked during the printing of a character and locking said tracing element with respect to the paper in the reached position during letter spacing movement, said spacing means comprising means for releasing the carriage at the end of the said character printing, said instructions conditioning said spacing means to shift said tracing element on said carriage along the printing line an amount equal to the required letter spacing in a direction opposite to that of letter spacing.

34. A printer according to claim 18, wherein said tracing element comprises a stylus, an ink ribbon being interposed between said stylus and the paper, the printing being effected by the pressure exerted by said stylus against said ribbon.

35. An electronic typewriter, comprising a single tracing element for tracing alphanumeric characters, spacing means for relatively moving said tracing element and the paper in a letter spacing relationship, a read-only memory for storing addressable numerical instructions for each one of said characters, driving means adapted to be controlled for driving said tracing element as to move along a pair of coordinates, an entry keyboard, and an encoder for producing in response to the depression of each key of said keyboard a code addressing the said memory for extracting the instructions to cause said tracing element to trace a corresponding character, printing control means operable for conditioning said driving means according to a character to be printed, detecting means for detecting the position of said tracing element, D/A converting means for converting the numerical instructions so addressed into command signals, comparison means for comparing the signals given by said detecting means and by said converting means, and servo control means conditioned by said comparison means for controlling said driving means.

36. An electronic typewriter according to claim 35, comprising a supplementary read-only memory containing additional instructions relating to additional characters including underlining, and accents, and manual controls for automatically addressing said additional instructions to be added to the instructions of each character in the control of said tracing element.

37. An electronic typewriter as in claim 35, comprising line-spacing means, and a manually operable device for exchanging the command of the movement of the said tracing element along the said coordinates in such manner as to print the characters rotated through 90°, the said manually operable device being moreover adapted to exchange the command of the said letter spacing means with the command of the line-spacing means.

38. An electronic typewriter according to claim 36, comprising a console of commands for selecting at least one variable of a group of variables including the form, the size and the thickness of the printed sign and of said additional characters.

39. An electronic typewriter according to claim 35, comprising mounting means for mounting said memory as to be readily removable for replacement with a memory storing instructions for printing characters of different form.

40. An electronic typewriter according to claim 35, wherein said numerical instructions comprise for each character a group of bits controlling said spacing means for defining the letter spacing of the character being traced, comprising a register for storing said bits during the tracing of a character, clearing means for clearing said register upon addressing the instruction of a subsequent character, and a back space command controlled by the bits stored in said register for conditioning said spacing means to back space said tracing element a distance equal to the letter spacing effected upon printing the last character.

41. An electronic typewriter according to claim 36, wherein said addressable numerical instructions define the speed of said tracing element along said pair of coordinates during a predetermined adjustable time interval.

42. An electronic typewriter according to claim 35, comprising mounting means for mounting said memory as to be readily removable for replacement with a different memory for altering the correspondence between said entry keyboard and the character to be printed.

43. An electronic printer having a single tracing element for tracing alphanumeric characters, comprising spacing means for relatively moving said tracing element and the paper in a letter spacing relationship, driving means for shifting said tracing element along a pair of coordinates parallel to the printing plane independently of the said letter spacing, for tracing each character, storing means for storing a set of addressable instructions for each one of said characters, addressing means conditionable for sequentially addressing the instructions of a predetermined character, detecting means for detecting the instantaneous speed of the said tracing element, comparison means for comparing the signals of said detecting means and the signals corresponding to said instructions and servo control means conditioned by said comparison means for controlling said driving means.

44. An electronic printer having a single tracing element for tracing alphanumeric characters, comprising spacing means for relatively moving said tracing element and the paper in a letter spacing relationship, driving means for shifting said tracing element along a pair of coordinates parallel to the printing plane independently of the said letter spacing, for tracing each character, storing means for storing a set of addressable instructions for each one of said characters, addressing means conditionable for sequentially addressing the instructions of a predetermined character, detecting means for detecting the instantaneous acceleration of said tracing element, integrating means for the signals of said detecting means, comparison means for comparing the signals of said integrating means and the signals corresponding to said instructions and servo control means conditioned by said comparison means for controlling said driving means.

* * * * *

UNITED STATES PATENT AND TRADEMARK OFFICE

CERTIFICATE OF CORRECTION

PATENT NO. : 4,150,902

DATED : April 24, 1979

INVENTOR(S) : Riccardo Brescia

It is certified that error appears in the above-identified patent and that said Letters Patent are hereby corrected as shown below:

Column 2, line 13: "bock" should read — block —

Column 6, line 63: "With" should read — When —

Column 7, line 44: "Semiconducts" should read — semiconductors —

Column 7, line 58: should not be a new paragraph

In the Table at the end of Column 10: Under Columns $a_8$, $a_9$, $a_{10}$, and $a_{11}$, Group 4, should read — 0 0 1 0 —

Column 11, line 32: "permit" should read — permits —

Column 11, line 55: "i" should read — i — line 56: "o" should read — o — line 57: "m" should read — m —

Column 12, line 9: after "plotting", insert — of —

Column 15, line 23: "enough large" should read — large enough —

Column 15, line 27: before "like", insert — the —

Column 15, line 49: "is" first occurrence should read --in--; and after "when", insert — it —

Column 17, line 11: "print" should read — printed —

Column 17, line 26: "to" should read — the —

Claim 3, first line, "4" should read — 2 —

Claim 33, first line, — A — should be inserted before "printer"

UNITED STATES PATENT AND TRADEMARK OFFICE

CERTIFICATE OF CORRECTION

PATENT NO. : 4,150,902

DATED : April 24, 1979

INVENTOR(S) : Riccardo Brescia

It is certified that error appears in the above-identified patent and that said Letters Patent are hereby corrected as shown below:

Claim 38, first line: "36" should read — 35 —

Claim 41, first line: "36" should read — 35 —

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*